United States Patent [19]

Mason, Jr.

[11] Patent Number: 4,506,799

[45] Date of Patent: Mar. 26, 1985

[54] FRUIT BOWL

[76] Inventor: Stanley I. Mason, Jr., 61 River Rd., Weston, Conn. 06880

[21] Appl. No.: 529,374

[22] Filed: Sep. 6, 1983

[51] Int. Cl.[3] ..... A47F 5/16; B65D 8/08; B65D 85/34

[52] U.S. Cl. ..... 220/69; 34/238; 98/52; 211/14; 220/72; D7/22

[58] Field of Search ..... 220/1 R, 72, 69, 23.8; D7/17, 22, 47, 3, 27, 23; 211/13, 14; 210/464, 472, 473, 413; D9/427, 428, 429; 217/42; 34/238; 98/52

[56] References Cited

U.S. PATENT DOCUMENTS

| | | | |
|---|---|---|---|
| D. 16,633 | 4/1886 | Gerard | D7/3 |
| D. 175,498 | 9/1955 | Easton | D7/17 |
| D. 182,479 | 4/1958 | Roop | D7/47 |
| D. 246,026 | 10/1977 | Stahel | D7/47 X |
| D. 272,222 | 1/1984 | Cho | D7/47 |
| 1,509,549 | 9/1924 | Freeland | 217/42 X |
| 2,067,830 | 1/1937 | Depew | 98/52 |
| 2,582,245 | 1/1952 | Folli | 211/14 |
| 2,802,411 | 8/1957 | Riener | 220/72 X |
| 3,049,259 | 8/1962 | Mazzi et al. | 217/26.5 |
| 3,306,484 | 2/1967 | Padovani | 217/26.5 |
| 3,655,114 | 4/1972 | Turner | 217/42 X |
| 3,695,453 | 10/1972 | Martelli | 211/14 |
| 3,821,061 | 6/1974 | Schier | D7/22 X |
| 3,927,769 | 12/1975 | Maslow | 34/238 X |

*Primary Examiner*—Allan N. Shoap
*Attorney, Agent, or Firm*—Haynes N. Johnson

[57] ABSTRACT

There is disclosed a bowl for storing fruit or vegetables in such a manner as to minimize spoilage. The bowl is mounted on a pedestal and has holes in the bottom to permit the entrance of air. Formed on the inner surface of the bowl are a plurality of ribs which support the fruit or vegetables with minimal surface contact and also form channels for the flow of air therebetween.

4 Claims, 4 Drawing Figures

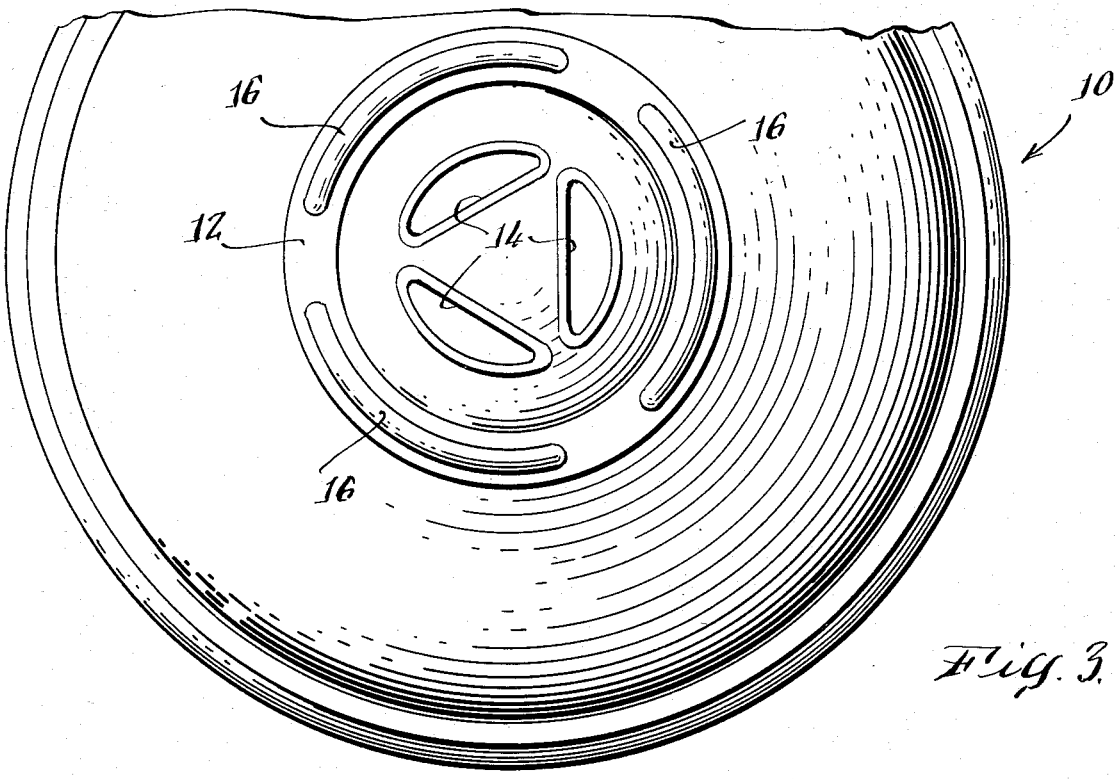
Fig. 3.
Fig. 4.
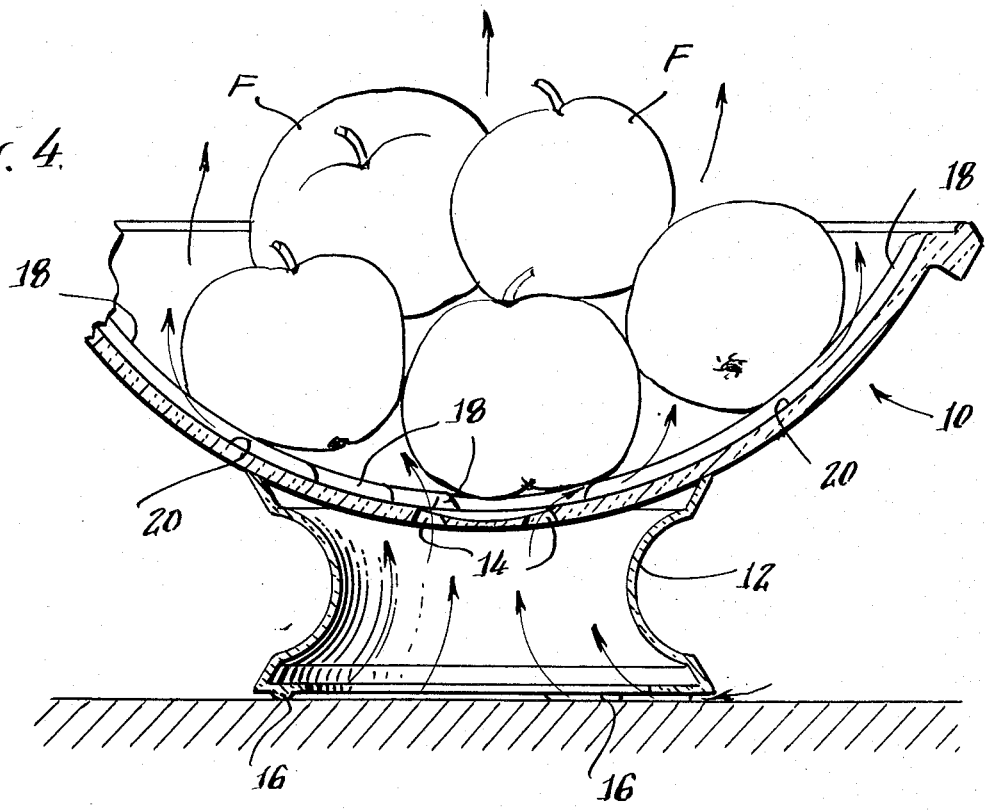

FRUIT BOWL

BACKGROUND OF THE INVENTION

Fruit and vegetables stored in conventional bowls or other containers often have a tendency to rot and spoil. Spoilage is particularly apt to occur on those surfaces which come into contact with the container. These areas of contact are not exposed to circulating air and this, coupled with the natural moisture on the surface of the fruit, provides an ideal breeding ground for the microorganisms which cause spoilage. Accordingly, it is a primary object of the present invention to provide an improved storage bowl for fruit and vegetables which minimizes spoilage. Other objects, features and advantages will become apparent from the following description and appended claims.

SUMMARY OF THE INVENTION

A receptacle is provided for storing fruit while minimizing any tendency of the fruit to rot. The receptacle includes a generally concave bowl which defines in the lower portions thereof openings permitting air and other gases to pass freely between its interior and exterior. A base elevatedly supports the bowl. A plurality of spaced ribs on the inner surface of the bowl support fruit and form air flow channels therebetween.

BRIEF DESCRIPTION OF THE DRAWINGS

FIG. 3 is a partial bottom view of the bowl of FIGS. 1 and 2; and,

FIG. 4 is a cross-section taken substantially along the line 4—4 of FIG. 1.

DESCRIPTION OF THE PREFERRED EMBODIMENT

Figure 1:
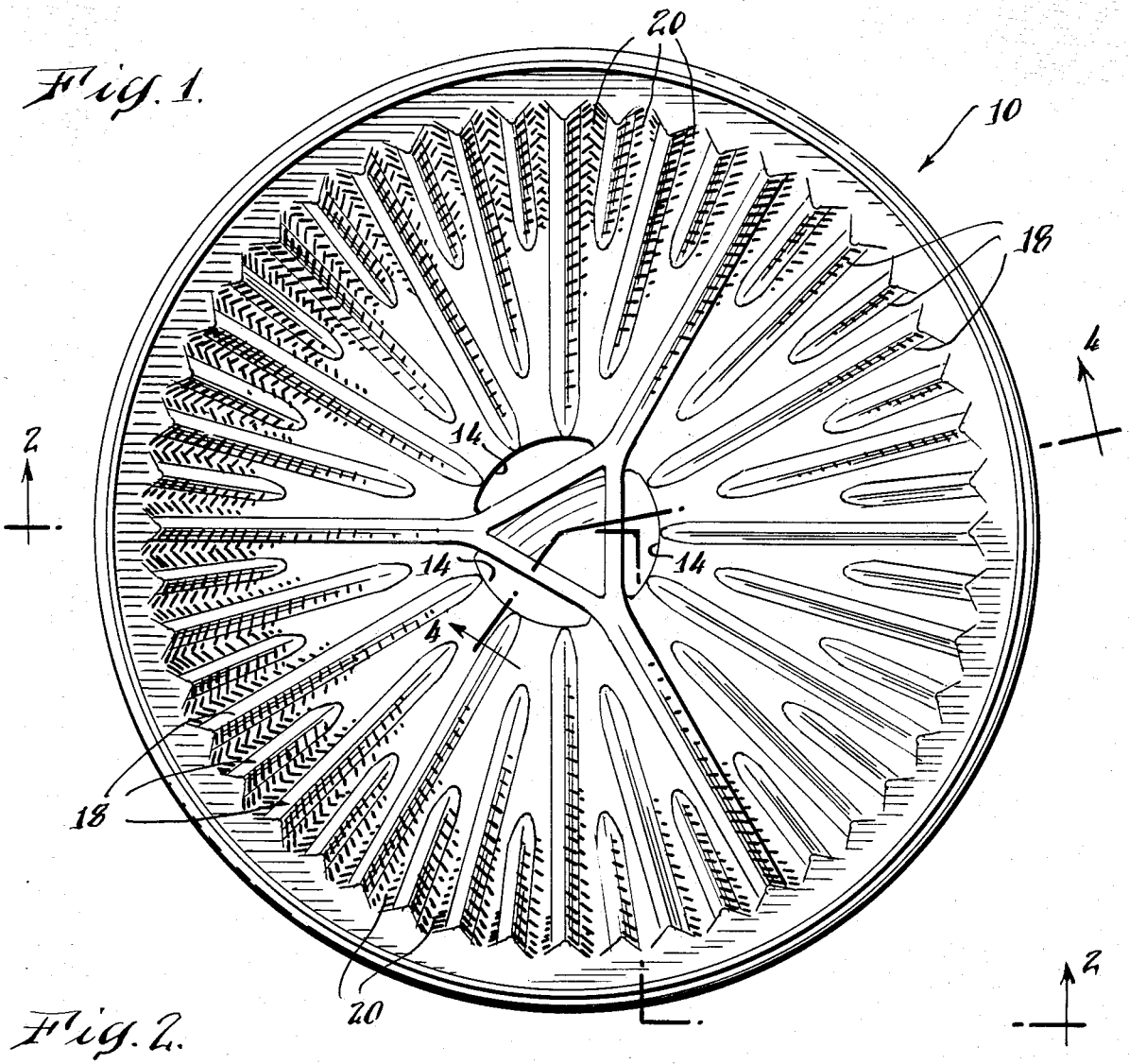
FIG. 1 is a top view of a fruit and vegetable storage bowl constructed in accordance with the present invention.
Figure 2:
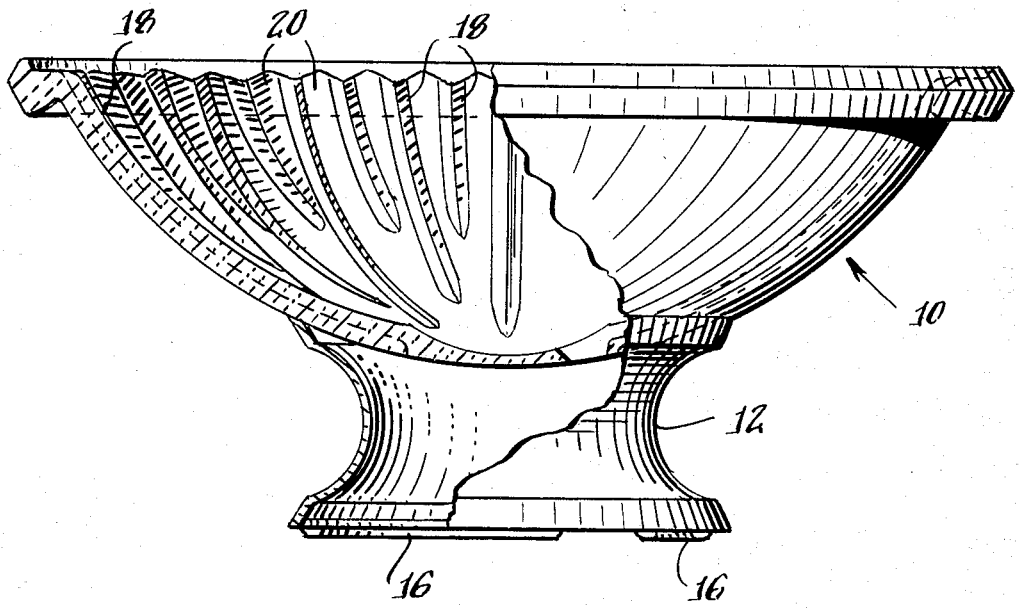
FIG. 2 is a cross-section taken substantially along the line 2—2 of FIG. 1.

The receptacle of this invention comprises a generally hemispherical bowl 10 mounted upon a hollow pedestal 12. The bottom of the bowl 10 defines a plurality of air inlet openings 14. The hollow pedestal 12 is flared at its bottom and rests upon a plurality of arcuate feet 16 which define air spaces therebetween. The inner surface of the bowl 10 is formed with a plurality of spaced ribs 18. Ribs 18 are generally triangular in cross-section, being broader at the surface of the bowl 10 and narrowing to a slightly rounded knife edge. In the preferred embodiment, as shown in FIGS. 1 and 2, the ribs 18 are essentially radial (as viewed from above) and thereby define air channels 20 which extend from the air inlet openings 14 to the edge of the bowl 10.

The manner in which the bowl of the invention functions to reduce spoilage will be most apparent from FIG. 4. In FIG. 4 articles of fruit F, such as apples, are shown within the bowl. They rest upon the ribs 18 so that minimal contact is made with the surface of the fruit. The spaces between the arcuate feet 16 permit air flow therebetween, as shown by the arrows, and air is thereby free to pass through the hollow pedestal 12, through the air inlet openings 14, and along the channels 20. This air circulation serves to evaporate moisture from the surface of the fruit and helps to keep it cool, thereby making conditions less conducive to the proliferation of microorganisms that would otherwise cause spoilage.

The receptacle of this invention can be made from any conventional material, such as pottery, glass, plastic, or metal. For optimum performance it is recommended that the ribs 18 should not be closer than ¼ inch apart nor more than 2 inches apart. It is also recommended that the rounded "knife edges" which touch the fruit should be not less than 1/64 inch in width nor greater than ¼ inch.

It will be apparent to those skilled in the art that a number of variations and modifications may be made in this invention without departing from its spirit and scope. Accordingly, the foregoing description is to be construed as illustrative only, rather than limiting. This invention is limited only by the scope of the following claims.

What is claimed is:

1. A receptacle for storing fruit while minimizing any tendency of the fruit to spoil, including a generally concave bowl having openings in the lower portion thereof, a hollow pedestal base having air inlets therein, said base supporting said bowl and said air inlets connecting through said base with said openings in said bowl to provide a convective air flow pattern upwardly through said base and into said bowl, a plurality of rounded, raidal, spaced ribs on the inner surface of said bowl so spaced as to support fruit above the inner surface of said bowl, said openings being surrounded by said ribs, whereby fruit may be held in said bowl spaced from the inner surface thereof and subjected to ambient conventive air flow to minimize the spoiling thereof.

2. A receptacle as set forth in claim 1 in which said pedestal base includes arcuate feet forming said air inlets.

3. The receptacle of claim 1 wherein said ribs are spaced not less than 0.25 inch nor more than 2 inches apart.

4. The receptacle of claim 1 wherein the fruit-contacting surface of each rib is not less than 1/64 inch nor more than ¼ inch in width.

* * * * *